US010767339B2

(12) United States Patent
Wagner et al.

(10) Patent No.: US 10,767,339 B2
(45) Date of Patent: Sep. 8, 2020

(54) MULTIPLE INTERFACE TOOL FOR A CONSTRUCTION MACHINE

(71) Applicant: Guangxi LiuGong Machinery Co., Ltd., Liuzhou Guangxi (CN)

(72) Inventors: Edward Wagner, Guangxi (CN); Gary Major, Staffordshire (GB); Yunfeng Zhao, Guangxi (CN)

(73) Assignee: Guangxi LiuGong Machinery Co., Ltd., Liuzhou, Guangxi (CN)

( * ) Notice: Subject to any disclaimer, the term of this patent is extended or adjusted under 35 U.S.C. 154(b) by 93 days.

(21) Appl. No.: 16/110,104

(22) Filed: Aug. 23, 2018

(65) Prior Publication Data

US 2019/0368157 A1 Dec. 5, 2019

Related U.S. Application Data

(63) Continuation of application No. PCT/CN2018/089554, filed on Jun. 1, 2018.

(51) Int. Cl.
*E02F 3/36* (2006.01)

(52) U.S. Cl.
CPC ..... *E02F 3/3604* (2013.01); *E02F 3/3609* (2013.01); *E02F 3/3686* (2013.01)

(58) Field of Classification Search
CPC ..... E02F 3/3604; E02F 3/3609; E02F 3/3618; E02F 3/3622; E02F 3/3627; E02F 3/364; E02F 3/3645; E02F 3/3659; E02F 3/3663; E02F 3/3686
USPC ..... 37/468; 414/723
See application file for complete search history.

(56) References Cited

U.S. PATENT DOCUMENTS 4,373,852 A * 2/1983 Maurer ..... E02F 3/3631 172/272
2015/0042113 A1* 2/2015 Cloutier ..... E02F 3/962 294/68.26

FOREIGN PATENT DOCUMENTS

| | | | | |
|---|---|---|---|---|
| AT | 12093 U1 | 10/2011 | | |
| DE | 102005037105 B3 * | 11/2006 | ..... | E02F 3/3627 |
| EP | 1749939 A1 * | 2/2007 | ..... | E02F 3/3627 |
| FR | 3059685 A1 * | 6/2018 | ..... | E02F 3/3622 |
| GB | 966719 A | 8/1964 | | |
| JP | S57164158 U | 10/1982 | | |
| WO | 2013138907 A1 | 9/2013 | | |
| WO | WO-2018104614 A1 * | 6/2018 | ..... | E02F 3/3663 |

OTHER PUBLICATIONS

Extended European Search Report in corresponding European Patent Application EP18187274.8, dated Mar. 15, 2019, 9 pgs.

* cited by examiner

*Primary Examiner* — Saul Rodriguez
*Assistant Examiner* — Brendan P Tighe
(74) *Attorney, Agent, or Firm* — Young Basile Hanlon & MacFarlane, P.C.

(57) ABSTRACT

A tool for a construction machine includes a first interface that is located at a first location on the tool, and a second interface that is located at a second location on the tool being different from the first location, wherein each of the first interface and the second interface is individually configured to mount the tool on the construction machine, and wherein the construction machine includes a loader bucket.

20 Claims, 3 Drawing Sheets

MULTIPLE INTERFACE TOOL FOR A CONSTRUCTION MACHINE

CROSS-REFERENCE TO RELATED APPLICATION(S)

This application claims priority to PCT/CN2018/089554 filed Jun. 1, 2018, the content of which is incorporated herein in its entirety by reference.

TECHNICAL FIELD

This disclosure relates to a tool and a tool arrangement for a construction machine and to a method of utilizing a tool on a construction machine.

BACKGROUND

Construction machines having a bucket as a working tool that is mounted on an articulated boom are known. Additionally, said construction machines may carry a dozer blade that is mounted on the chassis of the construction machine. Said construction machine may either be operated in an excavator mode using the bucket on the articulated boom or in a dozer mode using the dozer blade.

SUMMARY

Disclosed herein are aspects, features, elements, implementations, and embodiments of tools and tool arrangements for construction machines.

An aspect of the disclosed embodiments is a tool for a construction machine according to the present disclosure. The tool includes a first interface and a second interface. The first interface is located at a first location on the tool. The second interface is located at a second location on the tool, wherein the second location is different from the first location. Each of the first interface and the second interface is individually configured to mount the tool on the construction machine.

In some embodiments, the interfaces of the tool may each be means for providing a connection of the tool with the construction machine. Accordingly, the tool includes two separate means for providing such connections. The connections may be mechanical connections. A first mechanical connection may connect the tool with the construction machine via the first interface. A second mechanical connection may connect the tool with the construction machine via the second interface. A mechanical connection may be an articulated connection, in particular an articulated joint. Additionally or alternatively, a mechanical connection may be a rigid connection, in particular a rigid coupling.

In some embodiments, the construction machine may provide different operational modes. In a first operational mode of the construction machine, the tool may be mounted on the machine via the first interface. In a second operational mode of the construction machine, the tool may be mounted on the construction machine via the second interface. Additionally or alternatively, one of the interfaces may be configured to mount the tool on the construction machine in two different operational modes of the machine.

In some embodiments, the tool may be mounted on a tool mount or a tool carrier of the construction machine via at least one of the interfaces. Mounting the tool on the construction machine is understood as installing or attaching the tool to the construction machine. Accordingly, some kind of interlocking of the tool and the construction machine may be required. The tool may be mounted on the construction machine for being utilized and/or for being stored on the construction machine.

In some embodiments, the construction machine may be a loader or an excavator providing at least one additional operational mode, in particular a dozer mode. The construction machine may be a combined excavator-dozer or loader-dozer. The tool may be configured such that it may be utilized as a loader and/or excavator bucket and/or as a dozer tool. The first interface may be configured to mount the tool on the construction machine in an excavator or loader mode, wherein the tool may be mounted on the articulated boom of the construction machine in the mode. The second interface may be configured to mount the tool on the construction machine in a dozer mode, wherein the tool may be mounted on the chassis of the construction machine in the mode. For this purpose, the tool may be mounted on the rear or front of the chassis of the construction machine.

According to the present disclosure, in some embodiments, a multi-functional tool for a construction machine is provided. The tool may serve different tool applications, e.g. it may be used as loader or excavator bucket and as a dozer tool. For utilizing the tool for said different applications, it comprises different tool interfaces, each of the interfaces being configured for mounting the tool on the construction machine. For example, if the tool is supposed to be used as a loader/excavator tool, it is mounted on the articulated boom of the construction machine via the first interface, and if the tool is supposed to be used as a dozer tool, it is mounted on the chassis of the construction machine via the second interface.

In some embodiments, the interfaces of the tool according to the present disclosure may be configured such that the first interface comprises a first locking means and the second interface comprises a second locking means. Each of the first locking means and the second locking means may be configured to engage with the construction machine. The locking means may be located adjacent or spaced apart from one another on the tool. The first and/or second locking means may comprise a male or female part of a locking mechanism, wherein the respective counterpart may be provided on the construction machine. The locking means may be configured to provide a single engagement configuration. Additionally or alternatively, the first and/or second locking means may provide different engagement configurations, e.g. the tool may be mounted on a tool mount of the construction machine in different orientations, which may be twisted relative to each other.

Generally, the locking means may be designed as any outwardly or inwardly protruding locking means that enables an attachment of the tool to the construction machine. The locking means may be designed as a latching means. Particularly, the first interface of the tool according to the present disclosure may comprise at least one handle for grabbing the tool by a tool mount of the construction machine. The tool mount may be provided at an articulated boom of the construction machine. Additionally, or alternatively, the second interface of the tool may comprise such a handle. For grabbing the handle, the tool mount may comprise a pliers-like device. The handle may be a pin. Two handles may be provided for a double grabbing of the tool.

In some embodiments, the second interface of the tool according to the present disclosure may comprise at least one bracket for attaching the tool to a tool carrier of the construction machine. Additionally, or alternatively, also the first interface of the tool may comprise such a bracket. The bracket may comprise at least one plate, wedge, or lip forming the bracket. For attaching the bracket to the construction machine, a plate-like device may be provided on the construction machine on which the bracket may be slid on. The plate-like device may be part of a tool carrier of the construction machine. Alternatively, or additionally, the first interface of the tool may be configured to engage with a tool carrier and/or the second interface of the tool may be configured to engage with a tool mount of the construction machine.

In some embodiments, the second interface of the tool according to the present disclosure may comprise two brackets which are spaced apart from each other. The two brackets may provide a double engagement by a tool carrier. This ensures a stiff and rigid connection between the tool and the tool carrier. The same may apply to the first interface regarding a respective double grabbing of the tool by the tool mount. Accordingly, with this embodiment, the tool is not bent or damaged when asymmetrical forces or moments are acting thereon during material handling, for example.

In some embodiments, the first interface and/or the second interface of the tool according to the present disclosure may comprise a detent for locking an engagement of the construction machine with the tool. The detent may be provided for preventing the tool from losing contact to the tool mount or tool carrier of the construction machine. Particularly, a pivoting of the tool when being grabbed by the tool mount or when being attached to the tool carrier may be blocked by engaging the detent. The tool mount or the tool carrier may comprise a latch or a bolt, which may snap in the detent. In other words, the latch or bolt may be slid or retained in the detent. Additionally, or alternatively, in a reverse arrangement, the tool may comprise a latch or bolt to be engaged with a detent, which is arranged on the tool mount or tool carrier of the construction machine.

In some embodiments, the tool according to the present disclosure may be designed such that the first interface is located on a first face of the tool and the second interface is located on a second face of the tool, the second face being different from the first face. The provision of the interfaces at different faces allows for a mounting of the tool with different configurations and/or orientations. The tool according to the present disclosure may further be designed such that the first face of the tool is angled with respect to the second face of the tool, in particular angled at an obtuse angle. The obtuse angle may be an angle between 90 degrees and 180 degrees. Alternatively, the angle between the first and second faces may be an acute angle.

In some embodiments, the present disclosure further concerns a tool arrangement for a construction machine. The tool arrangement comprises a tool according to any of the above described embodiments and a tool carrier that is configured to be attached to a chassis of the construction machine, wherein the tool is detachably mountable on the tool carrier via the first interface and/or the second interface. The tool may be any tool, in particular a bucket. By mounting the bucket on the tool carrier, it may be utilized as dozer tool. The bucket may be a loader bucket or an excavator bucket, which may be mounted via one of the interfaces on an articulated boom of the construction machine. The tool carrier of the tool arrangement according to the present disclosure may be an arm that is attachable to the chassis of the construction machine. The chassis may be a wheel-driven chassis or a chain-driven chassis.

In some embodiments, the tool arrangement according to the present disclosure may further comprise a hydraulic and/or electric adjustment mechanism, in particular a hydraulic positioning cylinder, for providing a height adjustability of the tool arrangement with respect to the chassis of the construction machine. Alternatively, or additionally, an electric actuator may be provided for adjusting the height of the tool arrangement with respect to the chassis of the construction machine. Changing the height of the tool may provide a tool storage position and a tool usage position, wherein the tool usage position may be a dozing position of the tool.

The embodiments of the present disclosure further concern a construction machine comprising a tool or a tool arrangement according to any of the above described embodiments.

The embodiments of the present disclosure further concern a method of utilizing a tool on a construction machine having an articulated boom. The construction machine may be the construction machine according to the above described embodiment. The method comprises the step of depositing or picking, by the articulated boom, the tool according to any of the above described embodiments on or from the tool carrier of the construction machine. Depositing and/or picking of the tool may be carried out by the tool mount or the tool carrier.

In some embodiments, a tool comprises an interface that is located on the tool. The interface is configured to mount the tool on a construction machine. In some embodiments, a tool arrangement comprises a tool that is mounted on a tool carrier of the construction machine. The tool carrier is attached to a chassis of the construction machine. In some embodiments, a construction machine, according to the principles of the present disclosure, includes such a tool arrangement. In some embodiments, the construction machine comprises an articulated boom.

Variations in these and other aspects, features, elements, implementations, and embodiments of the methods, apparatus, procedures, and algorithms disclosed herein are described in further detail hereafter.

BRIEF DESCRIPTION OF THE DRAWINGS

The disclosure is best understood from the following detailed description when read in conjunction with the accompanying drawings. It is emphasized that, according to common practice, the various features of the drawings are not to scale. On the contrary, the dimensions of the various features are arbitrarily expanded or reduced for clarity.

DETAILED DESCRIPTION

Embodiments of the present disclosure are subsequently described with reference to the attached FIGS. 1 to 7.

Figure 1:
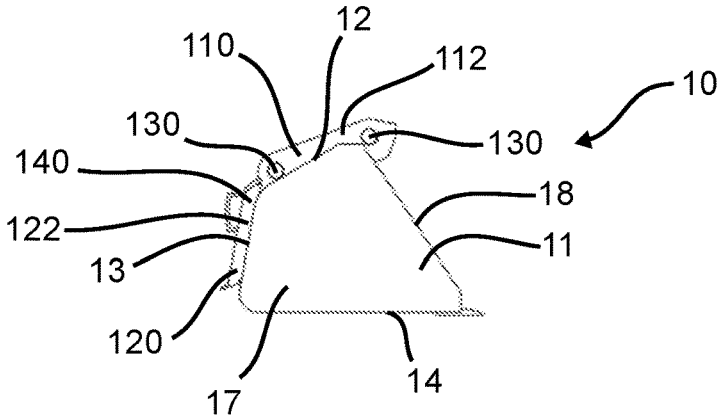
FIG. 1 generally illustrates a side view of a tool according to the principles of the present disclosure.
Figure 2:
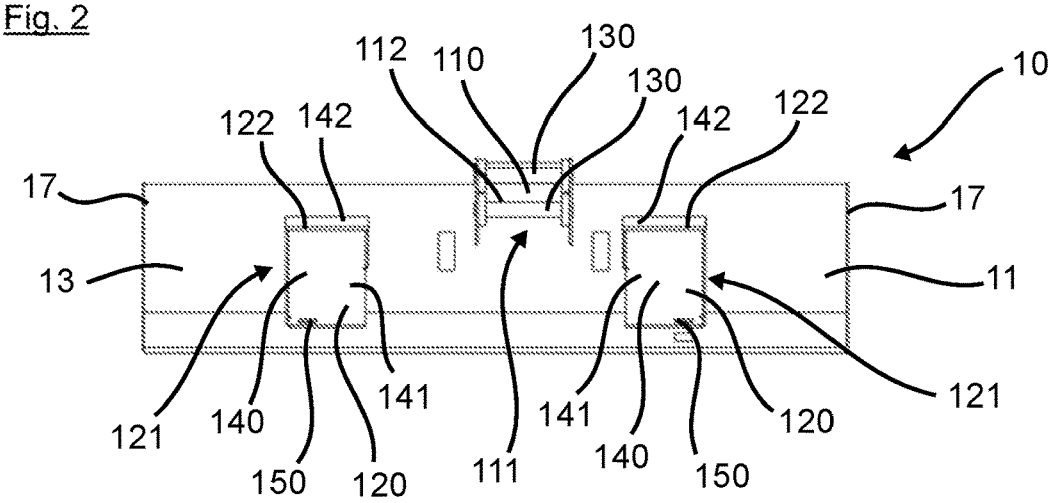
FIG. 2 generally illustrates a back view of the tool of FIG. 1.
Figure 3:
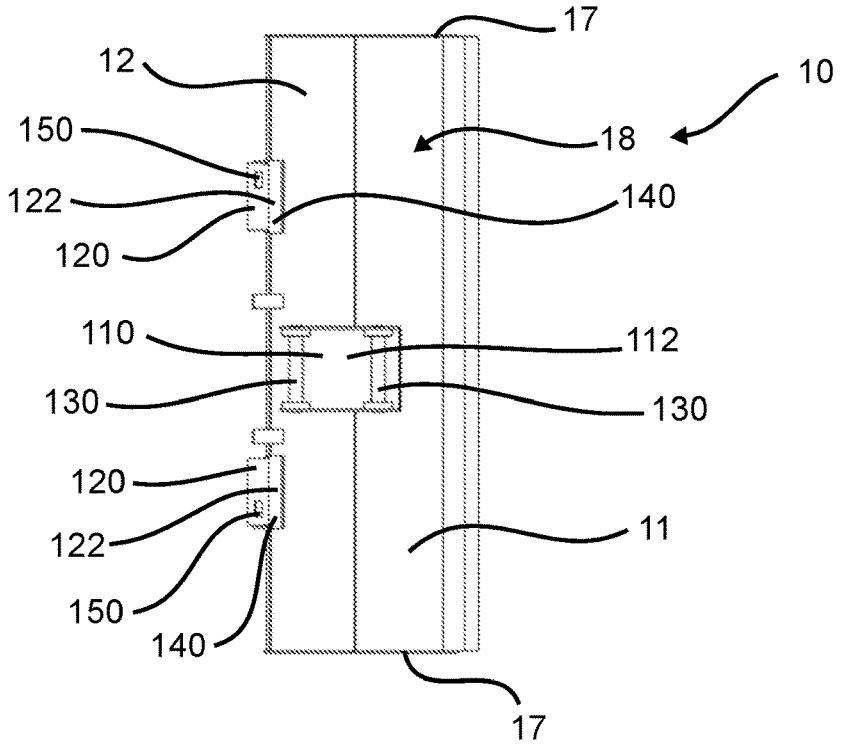
FIG. 3 generally illustrates a top view of the tool of FIG. 1.

FIGS. 1 to 3 show an embodiment of a tool 10 according to the present disclosure. In this embodiment, the tool 10 is designed as a loader bucket 11. The loader bucket 11 is configured for being mounted on a tool carrier 40 and on an articulated boom 2 of a construction machine 1, as shown in FIGS. 4 to 7.

The loader bucket 11 may have five faces, a first face 12 as a top face, a second face 13 as a rear face, a third face 14 as a bottom face and two side faces 17. Said five faces 12, 13, 14, 17 may form a bucket as a partly closed container being open at a front 18. Thus, the faces 12, 13, 14, 17 define the volume of the loader bucket 11. The angle between the first face 12 and the second face 13 may be approximately 135 degrees in the present embodiment.

The loader bucket 11 comprises a first interface 110 at a first location 111 and a second interface 120 at second locations 121. The first interface 110 is configured to mount the loader bucket 11 on an articulated boom 2, and the second interface 120 is configured to mount the loader bucket 11 on a tool carrier 40. The first interface 110 may be arranged on the first face 12 of the loader bucket 11 and the second interface 120 may be arranged on the second face 13 of the loader bucket 11. The first interface 110 may be located at a centered location 111 on the first face 12. The second interface 120 may be provided at two locations 121 on the second face 13, said two locations 121 being situated apart from one another. The two locations 121 may be arranged symmetrically to the centered location 111 on the loader bucket 11.

The first interface 110 may comprise a first locking means 112. The first locking means 112 may comprise two handles 130. Both handles 130 may be arranged parallel to the first face 12, wherein both handles 130 may be arranged above the first face 12. Both handles 130 may be grabbed by a tool mount 3 of the articulated boom 2.

The second interface 120 may comprise a second locking means 122. The second locking means 122 may comprise two brackets 140. Both brackets 140 may be spaced apart from each other and may be arranged substantially parallel to the second face 13. Both brackets 140 may include a base plate 141 and a protrusion 142 attached to the base plate 141 at an upper portion thereof, wherein the base plate 141 and the protrusion 142 may be angled with respect to each other with an acute angle forming a mounting support. A detent 150 may be provided in the base plate 141 as an opening. Both brackets 140 may be mounted on the tool carrier 40.

Figure 4:
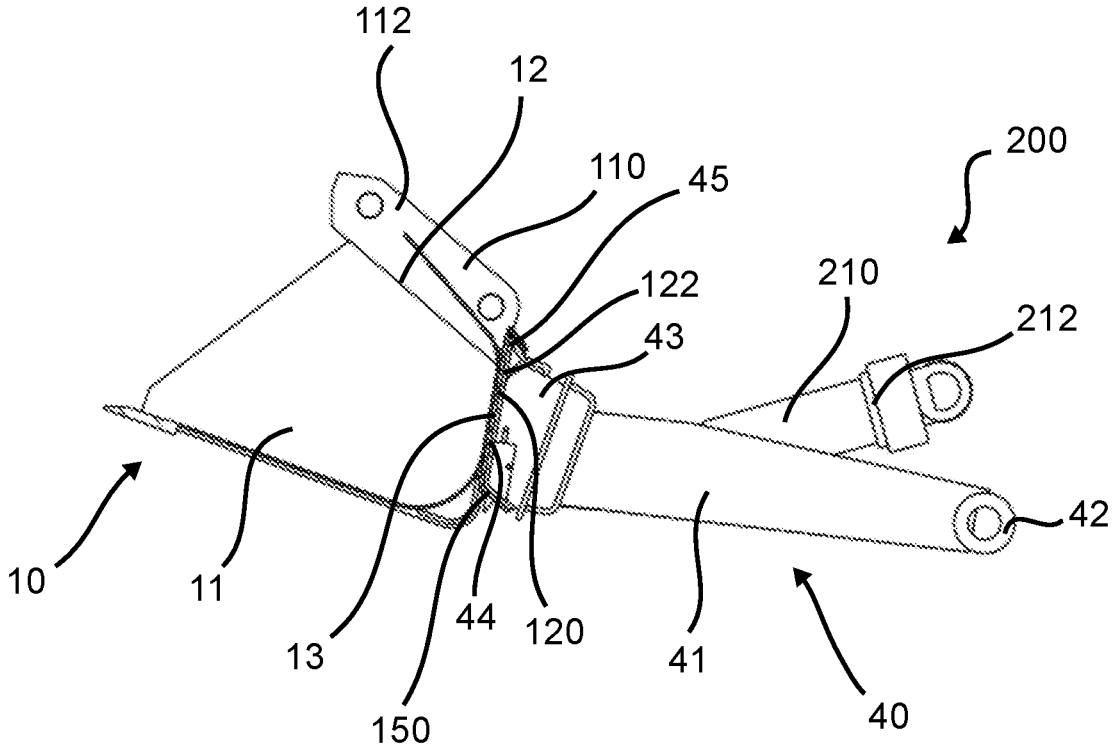
FIG. 4 generally illustrates a side view of a tool arrangement according to the principles of the present disclosure.
Figure 5:
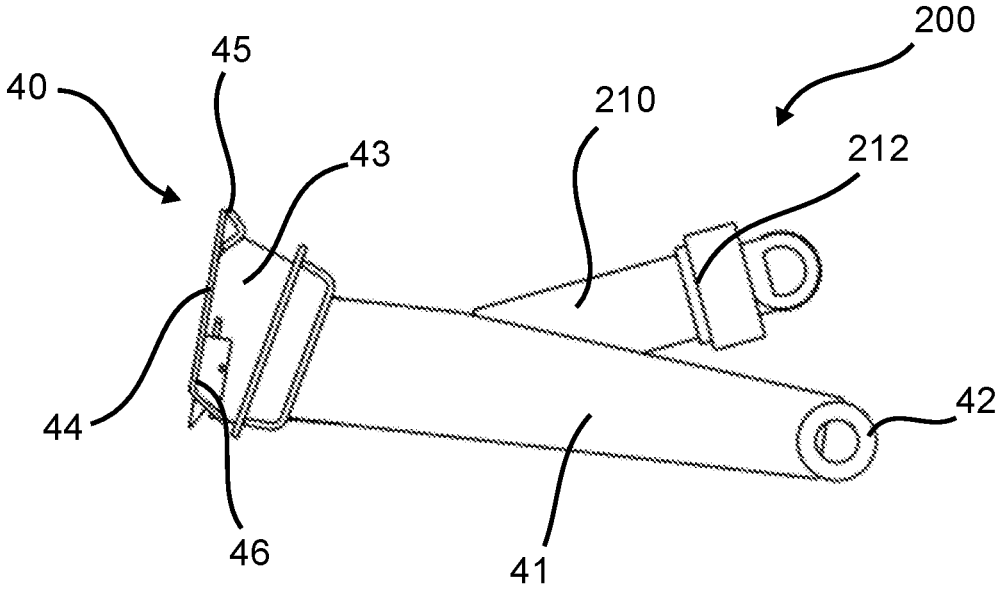
FIG. 5 generally illustrates a side view of a tool carrier of the tool arrangement of FIG. 4.

FIGS. 4 and 5 show an embodiment of a tool arrangement 200 according to the present disclosure. The tool arrangement 200 comprises a tool carrier 40, which is shown in combination with a tool 10 mounted thereon in FIG. 4 and alone in FIG. 5. In this embodiment, the tool 10 is the loader bucket 11 as described with reference to FIGS. 1 to 3 above.

The tool carrier 40 comprises a holding arm 41 with a pivot joint 42 at one end and a holder 43 at the other end thereof. The holding arm 41 may be pivotably attached to a chassis 4 of a construction machine 1 via the pivot joint 42. For actuating a pivoting movement of the holding arm 41, an adjustment mechanism 210 is provided. This adjustment mechanism 210 comprises a hydraulic positioning cylinder 212 interconnecting the holding arm 41 with the chassis 4 of the construction machine 1. By actuating the hydraulic positioning cylinder 212, the holding arm 41 with the holder 43 attached thereto is pivoted around the pivoting joint 42. Alternatively or additionally, an electric actuator (not shown) may be provided for pivoting the holding arm 41 around the pivoting joint 42. For this purpose, at least one battery (not shown) and an electric motor (not shown) may be arranged on the construction machine 1 for operating and powering the electric actuator.

The holder 43 of the tool arrangement 200 comprises two end plates 44 with a seating 45 at the top of each end plate 44 (only one end plate 44 is shown). The brackets 140 of the loader bucket 11 may be engaged with the end plates 44, wherein the protrusions 142 of the brackets 140 may rest on the seatings 45 of the end plates 44.

The holder 43 may further comprise a lock 46 arranged at least on one of the end plates 44. The lock 46 may engage with the detent 150 of the base plate 141 when the bracket 140 rests on the end plate 44, so as to realize a safety engagement. The lock 46 may be actuated manually, electrically and/or hydraulically by a manual, electric and/or hydraulic actuating mechanism (not shown).

Figure 6:
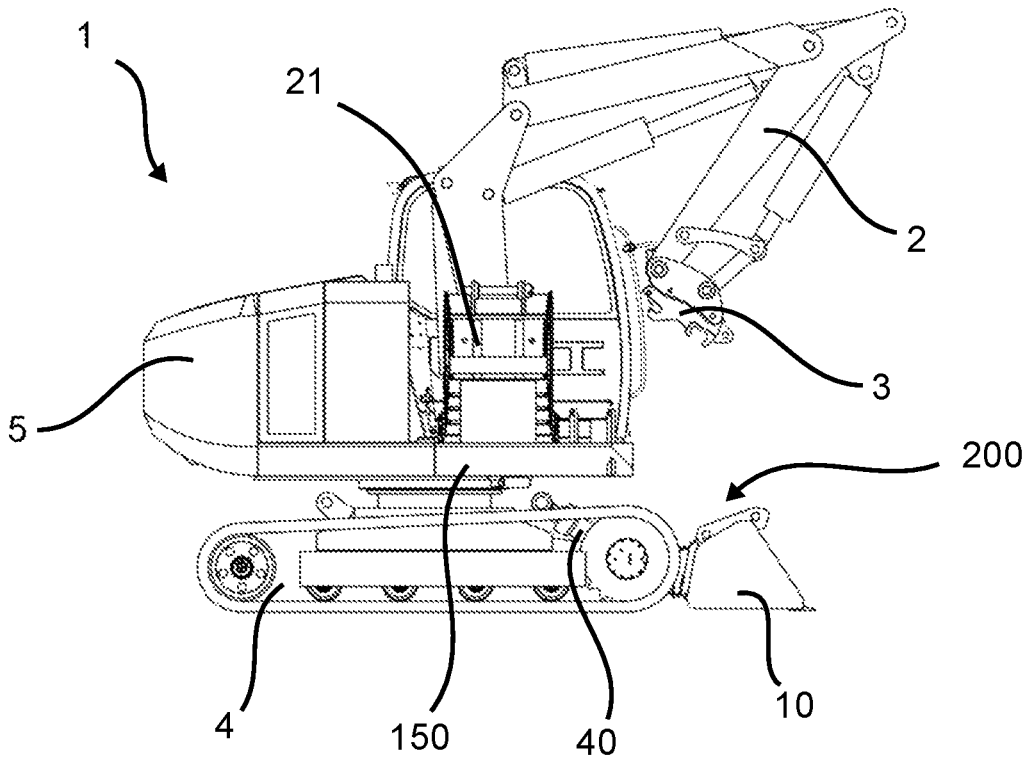
FIG. 6 generally illustrates a side view of a construction machine according to the principles of the present disclosure.
Figure 7:
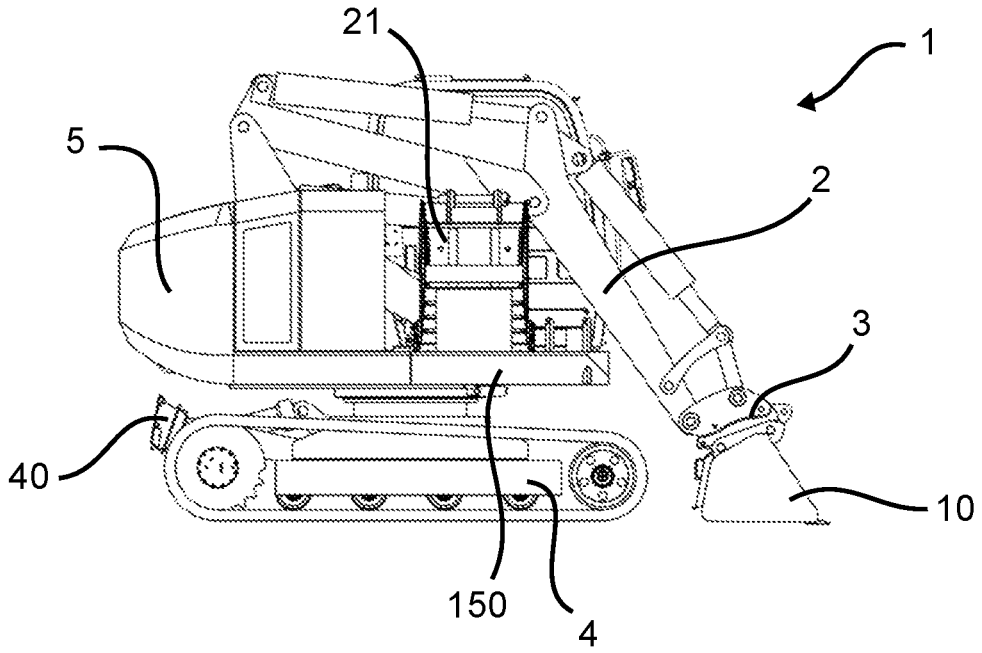
FIG. 7 generally illustrates a side view of the construction machine of FIG. 6.

FIGS. 6 and 7 show an embodiment of a construction machine 1 according to the present disclosure. The construction machine 1 of this embodiment is a chain-driven loader-excavator, which may additionally be operated in a dozer mode. The tool arrangement 200 of FIGS. 4 and 5 is arranged on a chassis 4 of the construction machine 1.

In FIG. 6, the tool 10 is mounted on the tool carrier 40 via the brackets 140. The construction machine 1 is operated in a dozer mode, in which the tool carrier 40 is pivoted downwards to place the bottom face 14 of the loader bucket 11 on the ground. In this operational mode, the articulated boom 2 is not in use and the loader bucket 11 is utilized as a dozer blade.

In FIG. 7, the tool 10 is mounted on a tool mount 3 of the articulated boom 2 of the construction machine 1 via the handles 130 to operate the construction machine in a loader mode. The construction machine 1 can be transferred from the dozer mode illustrated in FIG. 6 to the loader mode illustrated in FIG. 7 by picking up the tool 10, which is attached on the tool carrier 40 via the brackets 140, with the tool mount 3 of the articulated boom 2. Specifically, the tool mount 3 snaps into the first interface 110, i.e. the handles 130, of the loader bucket 11. After picking up the loader bucket 11 with the tool mount 3, the upper structure may be rotated by 180 degrees with respect to the chassis.

Furthermore, in FIGS. 6 and 7, an additional tool carrier 150 is shown, which may be provided on the construction machine 1 for storing and changing additional tools. Said tool carrier 50 may carry an additional excavator bucket 21, which may be mounted on the tool mount 3 of the articulated boom 2.

In the above described embodiments, a multi-functional tool 10 in combination with a construction machine 1 is described. Said tool 10 is configured to be used for different operational modes of the construction machine by comprising different interfaces 110, 120, each being designed for a specific one of said operational modes.

As used herein, the terminology "or" is intended to mean an inclusive "or" rather than an exclusive "or". That is, unless specified otherwise, or clear from context, "X includes A or B" is intended to indicate any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form.

Further, for simplicity of explanation, although the figures and descriptions herein may include sequences or series of steps or stages, elements of the methods disclosed herein may occur in various orders or concurrently. Additionally, elements of the methods disclosed herein may occur with other elements not explicitly presented and described herein.

Furthermore, not all elements of the methods described herein may be required to implement a method in accordance with this disclosure. Although aspects, features, and elements are described herein in particular combinations, each aspect, feature, or element may be used independently or in various combinations with or without other aspects, features, and elements.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A tool for a construction machine, the tool including a loader bucket and comprising:

a first interface that is located at a first location on the tool and configured to mount the tool on the construction machine in a loader mode; and a second interface that is located at a second location on the tool being different from the first location and configured to mount the tool on the construction machine in a dozer mode, wherein each of the first interface and the second interface is alternatively configured to mount the tool on the construction machine.

2. The tool of claim 1, wherein the first interface comprises a first locking means, and the second interface comprises a second locking means, and wherein each of the first locking means and the second locking means is configured to be engaged with the construction machine.

3. The tool of claim 1, wherein the first interface comprises at least one handle for grabbing the tool by a tool mount of the construction machine.

4. The tool of claim 1, wherein the second interface comprises at least one bracket for attaching the tool to a tool carrier of the construction machine.

5. The tool of claim 1, wherein the second interface comprises two brackets spaced apart from each other.

6. The tool of claim 1, wherein the first interface or the second interface comprise a detent for a safety engagement of the construction machine with the tool.

7. The tool of claim 1, wherein the first interface and the second interface comprise a detent for a safety engagement of the construction machine with the tool.

8. The tool of claim 1, wherein the first interface is located on a first face of the tool and the second interface is located on a second face of the tool, the second face being different from the first face.

9. The tool of claim 8, wherein the first face of the tool is angled with respect to the second face of the tool, and wherein an angle between the first face and the second face is an obtuse angle.

10. A tool arrangement for a construction machine, comprising:

a tool according to claim 1; and a tool carrier configured to be attached to a chassis of the construction machine, wherein the tool is detachably mountable on the tool carrier via at least one of the first interface and the second interface.

11. The tool arrangement of claim 10, wherein the tool is detachably mountable on the tool carrier via the first interface.

12. The tool arrangement of claim 10, wherein the tool is detachably mountable on the tool carrier via the second interface.

13. The tool arrangement of claim 10, wherein the tool is detachably mountable on the tool carrier via the first interface and the second interface.

14. The tool arrangement of claim 10, further comprising an adjustment mechanism having a hydraulic positioning cylinder for providing a height adjustability of the tool arrangement with respect to the chassis of the construction machine.

15. The tool arrangement of claim 14, wherein the adjustment mechanism includes an electric adjustment mechanism.

16. The tool arrangement of claim 14, wherein the adjustment mechanism includes a hydraulic adjustment mechanism.

17. A method of utilizing the tool on the construction machine that includes an articulated boom, the construction machine being the construction machine according to claim 12, the method comprising:

depositing, by the articulated boom, the tool on the tool carrier of the construction machine.

18. A method of utilizing the tool on the construction machine that includes an articulated boom, the construction machine being the construction machine according to claim 13, the method comprising:

depositing, by the articulated boom, the tool on the tool carrier of the construction machine.

19. The tool of claim 1, wherein the tool is mountable on the construction machine via:

a first tool carrier adjustable in a vertical direction and connectable with the second interface; and a second tool carrier configured to store the tool and positioned above tracks of the construction machine.

20. The tool of claim 19, wherein the first tool carrier comprises a pivot joint configured to hold the tool at the second interface.

* * * * *